US005594206A

United States Patent [19]

Klas et al.

[11] Patent Number: 5,594,206

[45] Date of Patent: Jan. 14, 1997

[54] LABEL COVER CONSTRUCTION AND ARRANGEMENT THEREOF ON SWITCH FACEPLATE

[75] Inventors: Daniel E. Klas, Black Mountain; John M. Gentry, Candler; Regina L. Tipton, Nebo; Richard H. Dwyer, Marion, all of N.C.

[73] Assignee: Hubbell Incorporated, Orange, Conn.

[21] Appl. No.: 254,069

[22] Filed: Jun. 3, 1994

[51] Int. Cl.[6] ..... H01H 9/02; H01H 13/04

[52] U.S. Cl. ..... 174/56; 174/66; 174/67

[58] Field of Search ..... 174/66, 67, 55, 174/56

[56] References Cited

U.S. PATENT DOCUMENTS

| | | | |
|---|---|---|---|
| 1,475,900 | 11/1923 | Thomas . | |
| 2,625,759 | 1/1953 | Koepke | 40/18 |
| 3,438,536 | 4/1969 | Tarchalski | 220/27 |
| 4,282,591 | 8/1981 | Andreuccetti | 368/10 |
| 4,479,317 | 10/1984 | Hanna | 40/2 R |

*Primary Examiner*—Kristine L. Kincaid
*Assistant Examiner*—Dean A. Reichard
*Attorney, Agent, or Firm*—Jerry M. Presson; Michael R. Swartz

[57] ABSTRACT

A switch cover plate assembly includes label covers each having an elongated main portion and a pair of opposite ends and a switch faceplate for mounting the label covers. The faceplate has a flat main panel, switch holes therethrough adapted to receive switch actuators, mounting holes therethrough adapted to receive therethrough fasteners to mount the faceplate to a switch box, and label cover mounting recesses and a pair of slots defined at opposite ends of each of the mounting recesses. Each mounting recess and pair of mounting slots are adapted to receive and mount one of the label covers. Each label cover is adapted to seat within one mounting recess and to be slidably insertable into and removable from the mounting slots. A pair of parallel opposite edge surfaces are defined on opposite sides of the mounting slots at inclined angles to the plane of the flat main panel so as to extend along and parallel to a path through which the opposite end portions of the label cover must slidably move in order to insert into and withdraw from the mounting slots. Each mounting hole is defined through the flat main plate in one of the mounting recesses and spaced from the mounting slots of the pair thereof defined at the opposite ends of the mounting recess. Also, each label cover also includes grooves defined in the main portion adjacent to opposite end portions of the respective label cover to permit insertion and engagement of an object, such as a fingernail, within the groove of the label cover in order to slidably move the label cover relative to the faceplate and into and from the mounting slots.

16 Claims, 4 Drawing Sheets

LABEL COVER CONSTRUCTION AND ARRANGEMENT THEREOF ON SWITCH FACEPLATE

BACKGROUND OF THE INVENTION

1. Field of the Invention

The present invention generally relates to an electrical switch cover assembly which employs removable label covers on a switch faceplate of the assembly and, more particularly, is concerned with an improved label cover construction and arrangement thereof on the switch faceplate of the switch cover assembly.

2. Description of the Prior Art

A conventional type of switch cover assembly used in many diverse applications typically employs a switch faceplate which fits over the front end of a switch box. The switch faceplate has an arrangement of switch holes formed therein for receiving therethrough switch actuators mounted to the switch box and mounting holes formed therein for receiving therethrough screws to mount the faceplate to the switch box. In one configuration of the switch faceplate employed in the telecommunications industry, label cover mounting recesses and slots are defined therein. The switch cover assembly also includes label covers which are designed to seat within the label cover mounting recesses and to removably slidably insert at opposite ends through the label cover mounting slots.

One drawback of this switch faceplate configuration is the scarcity of the space thereon in which to arrange the label cover mounting recesses and slots with the switch holes and mounting holes. The result is an arrangement which is crowded not only physically, which it is, but also in appearance which requires a user to have to devote more attention in using the switch assembly.

Another drawback of this switch faceplate configuration is the unaccommodating nature of the design of the label covers themselves and their mounting slots with respect to the insertion and removal of the opposite ends of the label covers into and from the mounting slots. In particular, flat edge surface portions are provided bounding the opposite ends of the mounting recesses and slots which extend substantially across a portion of the path along which the opposite ends of the cover plates must take in order to slidably insert their opposite ends through the mounting slots. These flat edge surface portions increase the difficulty for a user to insert and remove a label cover. Also there is a small aperture in one end of the label cover which requires the insertion of a hook formed on a length of thin bendable wire, such as a paper clip, in order to engage the label cover to slide and remove it. This task is tedious and difficult for some users to accomplish.

Consequently, a need exists for improvements in switch faceplate construction and/or label cover construction to make it easier and quicker to use the switch assembly and to insert and remove label covers into and from the switch faceplate.

SUMMARY OF THE INVENTION

The present invention provides an improved label cover construction and arrangement on the switch faceplate designed to satisfy the aforementioned needs. One improvement eliminates the first drawback by superimposing the label cover mounting recesses over the faceplate mounting holes in the switch faceplate. This rearrangement eliminates the separate areas on the faceplate heretofore occupied by the mounting holes which now provides more space between the label cover recesses and the switch holes on the switch faceplate. Another improvement eliminates the second drawback by providing fingernail size grooves on the opposite ends of the front surface of the label covers to use in gripping and sliding the label cover and also by transforming portions of the flat edges surfaces bounding the opposite ends of the mounting recesses and slots into inclined or slanted edge surfaces which extend along and parallel to the path through which the opposite ends of the label cover must slide and thereby facilitate the insertion and removal of the label covers into and from the mounting slots, making it easier for a user to insert and remove the label covers.

Accordingly, the present invention is directed to a switch cover plate assembly which comprises: (a) at least one and preferably a plurality of label covers each having an elongated main portion and a pair of opposite end portions; and (b) a switch faceplate having a flat main panel, at least one and preferably a plurality of mounting holes defined through the main panel and adapted to receive therethrough fasteners to mount the faceplate to a switch box, and at least one and preferably a plurality of label cover mounting recesses and a pair of slots defined at opposite ends of each of the mounting recesses. Each of the recesses and pair of slots defined in the main panel and being adapted to receive and mount one of the plurality of label covers. Each of the label covers is adapted to seat within one of the label cover mounting recesses and to be slidably insertable into and withdrawable from the mounting slots. Each of the mounting holes is defined through the flat main plate in one of the mounting recesses and spaced from the mounting slots of the pair thereof defined at the opposite ends of the mounting recess.

Also, each of the label covers also includes an abutment formed by a groove defined in the main portion thereof adjacent to at least one and preferably both of the opposite end portions of the respective label cover to permit insertion and engagement of an object, such as a fingernail, within the groove of the label cover to slidably move the label cover relative to the faceplate along the mounting recess and into and from the mounting slots.

The faceplate of the switch cover plate assembly also includes a pair of opposite edge surface portions extending generally parallel to one another and spaced from one another on opposite sides of each of the slots. The parallel opposite edge surface portions extend in an inclined relation to the plane of said flat main panel of the faceplate so as to extend along and parallel to a path through which a respective one of the opposite end portions of the label cover must slidably move in order to insert into and withdraw from a respective one of the mounting slots.

The present invention also is directed to a switch faceplate which comprises: (a) a flat main panel; (b) means defining at least one mounting hole in the flat main panel adapted to receive therethrough a fastener to mount the faceplate to a switch box; and (c) means defining at least one label cover mounting recess in the flat main panel adapted to receive and mount a label cover, the label cover mounting recess overlying the mounting hole in the flat main panel.

Also, the main panel of the faceplate has at least a pair of mounting slots defined through the flat panel portion at opposite ends of the mounting recess. The mounting slots are adapted to receive opposite ends of the label cover seated in the main portion of the label cover. The mounting hole is defined through the main panel in the mounting recess about midway between a pair of opposite ends of the mounting recess.

These and other features and advantages and attainments of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the course of the following detailed description, reference will be made to the attached drawings in which.

DETAILED DESCRIPTION OF THE INVENTION

Figure 1:
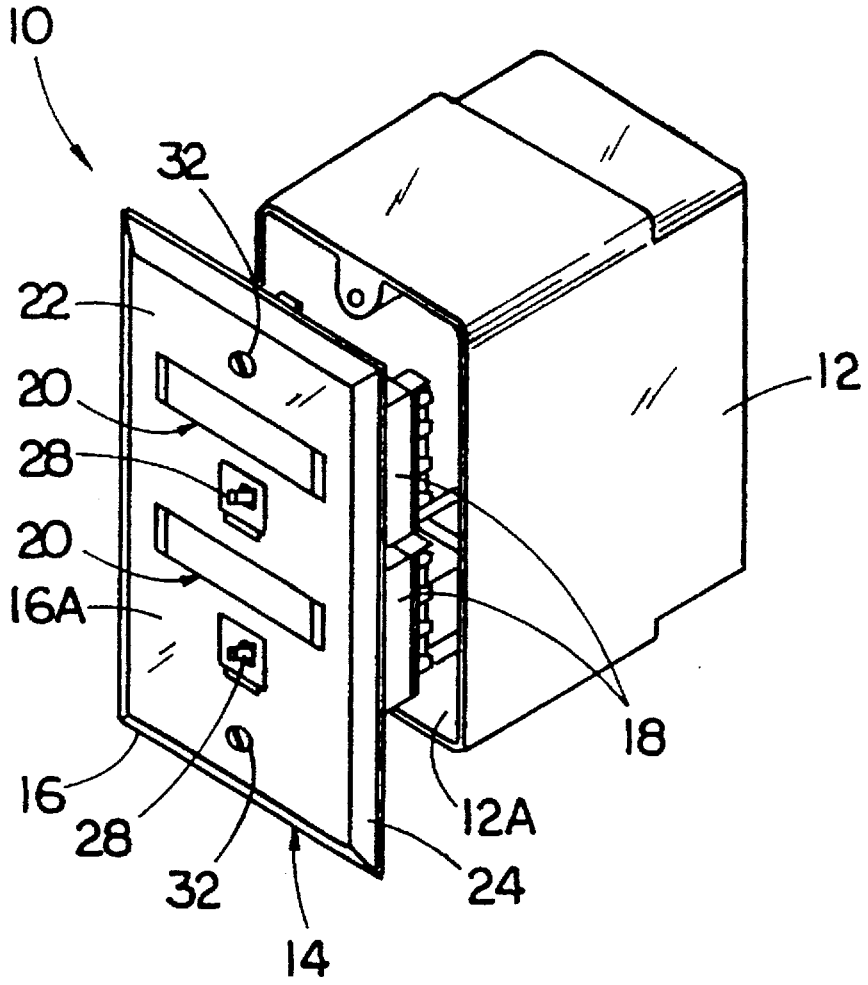
FIG. 1 (PRIOR ART)
FIG. 1 is an exploded perspective view of a prior art switch cover plate assembly showing a switch faceplate with switches and label covers mounted thereto and the faceplate being aligned for mounting to a switch box.

In the following description, like reference characters designate like or corresponding parts throughout the several views. Also in the following description, it is to be understood that such terms as "forward", "rearward", "left", "right", "upwardly", "downwardly", and the like, are words of convenience and are not to be construed as limiting terms.

Prior Art Switch Cover Plate Assembly

Referring now to the drawings, and particularly to FIG. 1, there is illustrated a prior art electrical switch installation, generally designated 10, which includes a switch box 12 and a cover plate assembly 14. The cover plate assembly 14 includes a switch faceplate 16 with a plurality of switches 18 and label covers 20 mounted thereto and the switch faceplate 16 being aligned for mounting across the open front end 12A of the switch box 12.

Figure 2:
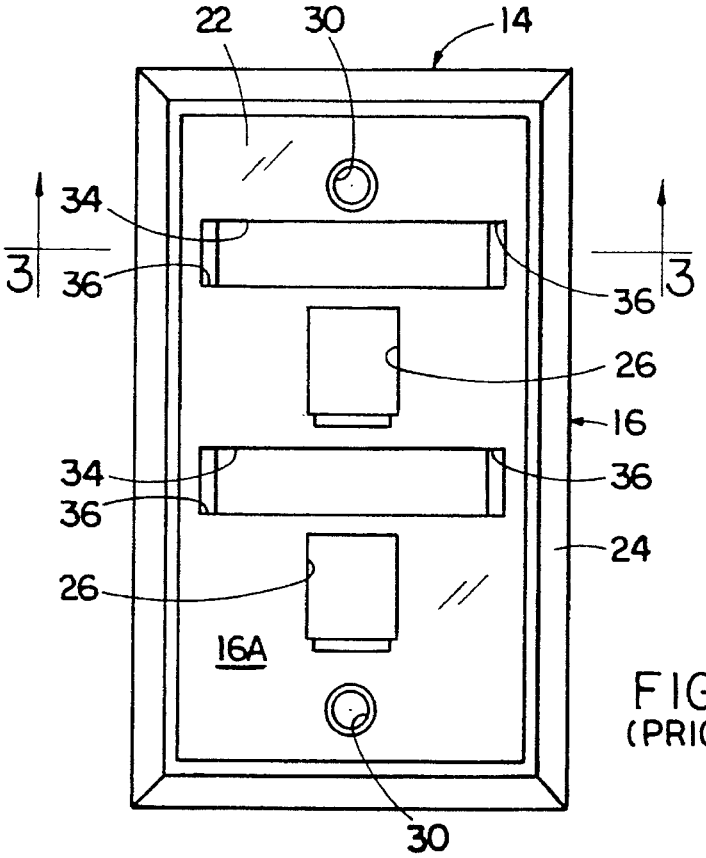
FIG 2 (PRIOR ART)
FIG. 2 is an enlarged front elevational view of the prior art switch faceplate alone.
Figure 3:
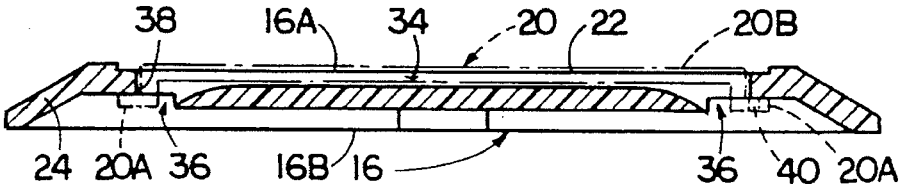
FIG 3 (PRIOR ART)
FIG. 3 is a horizontal sectional view of the prior art switch faceplate taken along line 3—3 of FIG. 2.

Referring to FIGS. 2 and 3, there is illustrated in greater detail the prior art switch faceplate 16 of FIG. 1. The switch faceplate 16 includes a flat main panel 22 of generally rectangular shape and an annular border 24 bounding the periphery of the main panel 22 and inclined outwardly and rearwardly therefrom. The faceplate 16 also has formed therein a plurality of switch holes 26 to receive therethrough the actuators 28 of the switches 18, a plurality of mounting holes 30 to receive therethrough screws 32 to mount the faceplate 16 to the switch box 12, and a plurality of label cover mounting recesses 34 and slots 36 to receive and mount the label covers 20. The mounting recesses 34 are formed in a front surface 16A of the faceplate, whereas the mounting slots 36 are defined through the main panel 22 of the faceplate 16.

Referring to FIGS. 2–5, the label covers 20 are designed to seat within the label cover mounting recesses 34 and to be slidable relative to the faceplate main panel 22 to insert and withdraw opposite end portions 20A of the label covers 20 into and from the mounting slots 36. The placement of the switch holes 26, the mounting holes 30 and the label cover mounting recesses 34 and slots 36 on separate portions or areas of the main panel 22 of the faceplate 16 results in an arrangement which is crowded not only in a physical sense, but also in an appearance sense to a user. Also, the main panel 22 of the faceplate 16 has a pair of flat edge surface portions 38 bounding the outer sides of the mounting slots 36 and opposite ends of the mounting recess 34 which cross at least a portion of the path along which the opposite end portions 20A of each label cover 20 must move in order to insert into and withdraw from the mounting slots 36. These flat edge surface portions 38 make it difficult for a user to smoothly and easily insert the opposite end portions 20A of the label cover 20 therethrough.

Figure 4:
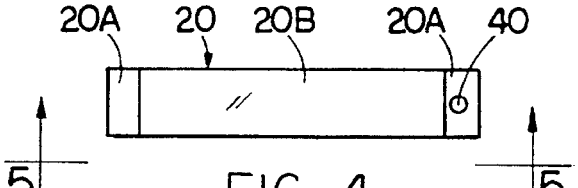
FIG 4 (PRIOR ART)
FIG. 4 is an enlarged front elevational view of one of the label covers alone.
Figure 5:
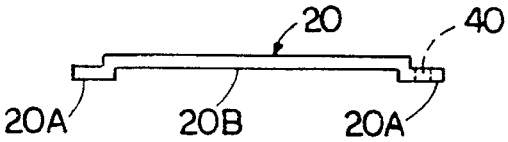
FIG 5 (PRIOR ART)
FIG. 5 is a side elevational view of the label cover as seen along line 5—5 of FIG. 4.
Figure 6:
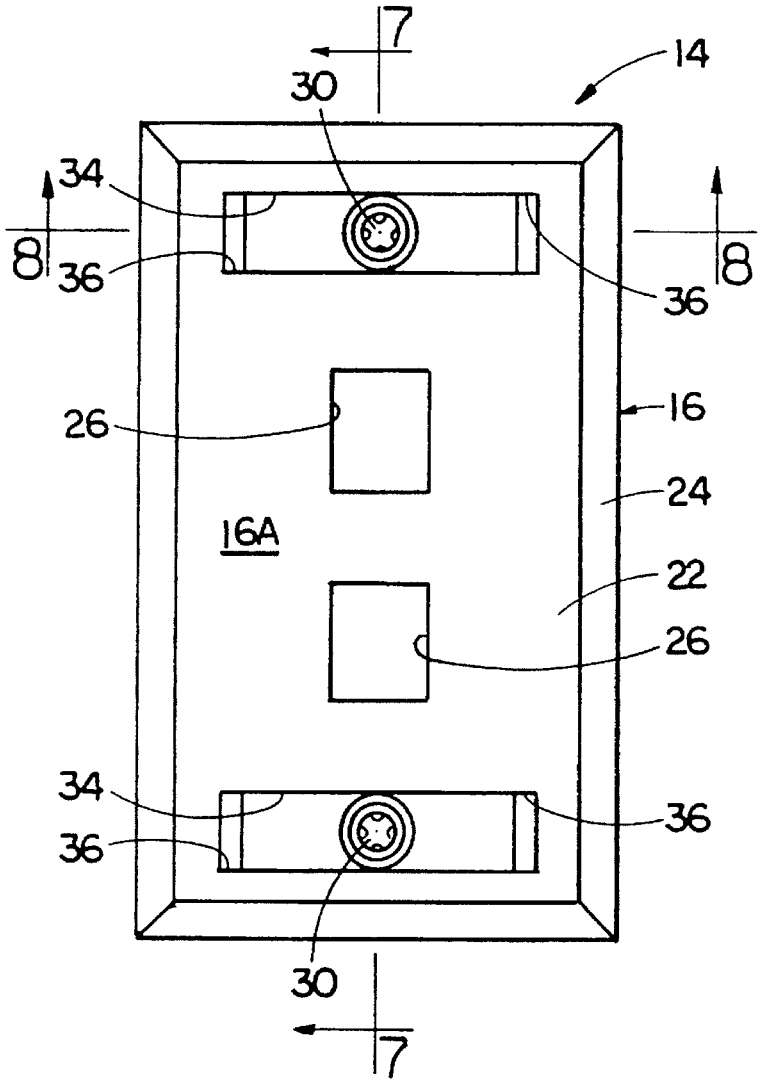
FIG. 6 is a front elevational view of an improved switch faceplate of the present invention.
Figure 7:
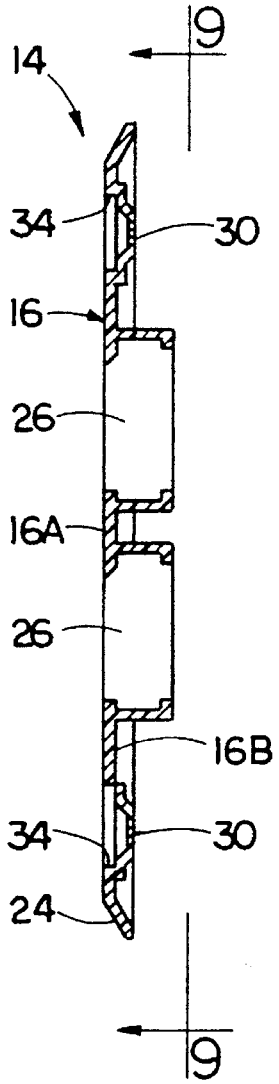
FIG. 7 is a vertical sectional view of the improved switch faceplate taken along line 7—7 of FIG. 6.
Figure 8:
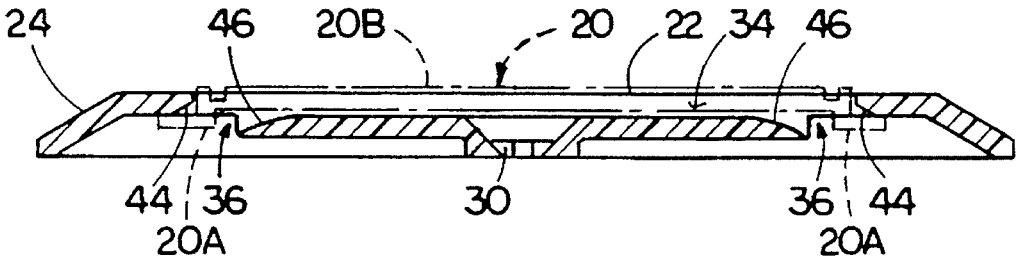
FIG. 8 is a horizontal sectional view of the improved switch faceplate taken along line 8—8 of FIG. 7.
Figure 9:
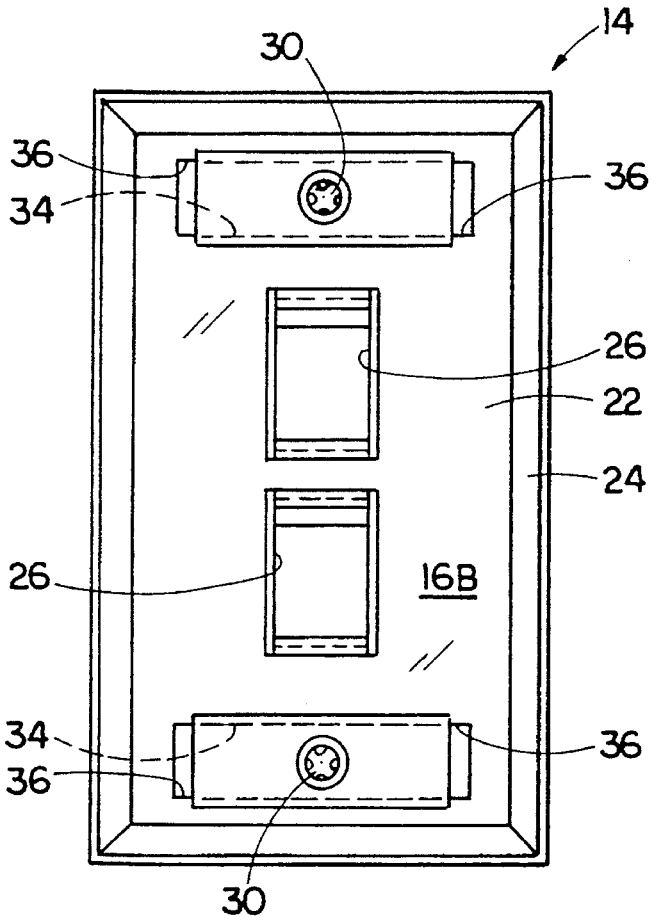
FIG. 9 is a rear elevational view of the improved switch faceplate as seen along line 9—9 of FIG. 7.
Figure 10:
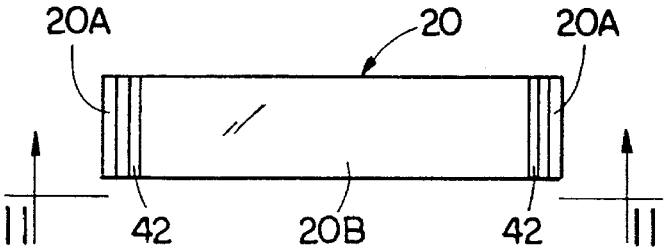
FIG. 10 is a front elevational view of an improved label cover of the present invention.
Figure 11:
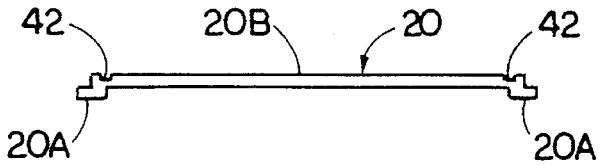
FIG. 11 is a side elevational view of the improved label cover as seen along line 11—11 of FIG. 10.

Referring to FIGS. 3–5, there is illustrated in greater detail one of the prior art label covers 20 which mounts to the mounting recesses 34 and pairs of slots 36 of the switch faceplate of FIGS. 2 and 3. Each label cover 20 includes an elongated main portion 20B and the opposite end portions 20A attached thereto. The label cover 20 is preferably made of a resilient semi-flexible semi-rigid material, such as a suitable plastic material, which permits limited flexing of the main portion 20B thereof so as to facilitate insertion and withdrawl of the opposite end portions 20A of the label cover 20 beyond the rear surface 16B of main panel 22. As seen in FIGS. 3–5, the opposite end portions 20A of each label cover 20 are step-shaped end portions 20A offset below and projecting outwardly beyond the main portion 20A such that when inserted through the mounting slots 36 they underlie portions of the rear surface 16B of the faceplate 16 adjacent to the mounting slots 36. Also there is a small aperture 40 in one of the opposite end portions 20A of the label cover 20 which requires the insertion of a hook formed on a length of thin bendable wire, such as a paper clip, in order to engage the label cover 20 to slide and withdraw it. This task is tedious and difficult for some users to accomplish.

Improved Switch Cover Plate Assembly

Referring to FIGS. 6–11, there is illustrated an improved switch cover assembly 14. It has the same construction as that shown in FIGS. 1–5, except for the improvements therein comprising the features of the present invention which will now be described in detail. One improvement relates to the relocation of the label cover mounting recesses 34 and mounting slots 36. Now, each of the mounting recesses 34 is defined in the front surface 16A of the main panel 22 of the faceplate 16 so as to overlie one of the mounting holes 30. Thus, each mounting hole 30 is defined through the flat main panel 22 in one of the mounting recesses 34 and is spaced from the mounting slots 36 of the pair thereof defined at the opposite ends of the respective mounting recess 34. More particularly, each mounting hole 30 is defined through the main panel 22 in the mounting recess 34 about midway between a pair of opposite ends of the mounting recess 34.

Also, each of the label covers 20 includes at least one and preferably a pair of cross grooves 42 defined in the main portion 20A thereof adjacent to at least one and preferably both of the opposite end portions 20A of the respective label cover 20 to permit insertion and engagement of a tool or object, such as a fingernail, within the groove 42 of the label cover 20 to allow the label cover 20, after being depressed at the respective opposite end portions 20A thereof, to be easily slidably moved relative to the faceplate 16 along the mounting recess 34 and into and from the mounting slots 36.

Finally, the faceplate 16 of the switch cover plate assembly 14 now also includes a pair of opposite edge surface portions 44, 46 extending generally parallel to one another and spaced from one another on opposite sides of the respective mounting slots 36. The parallel opposite edge surface portions 44, 46 extend in an inclined relation to the plane of the flat main panel 22 of the faceplate 16 so as to extend along and parallel to a path through which a respective one of the opposite end portions 20A of the label cover 20 must slidably move in order to insert into and withdraw from a respective one of the mounting slots 36. Instead of only one of the edge surface portions being inclined as was the case in the prior art construction of FIG. 3, now both of the edge surface portions 44, 46 have the parallel inclined configurations. These inclined surface portions 44, 46 facilitate easier insertion of the opposite end portions 20A into and through the mounting slots 36.

It is thought that the present invention and many of its attendant advantages will be understood from the foregoing description and it will be apparent that various changes may be made in the form, construction and arrangement of the parts thereof without departing from the spirit and scope of the invention or sacrificing all of its material advantages, the forms hereinbefore described being merely preferred or exemplary embodiments thereof.

We claim:

1. A switch cover plate assembly, comprising:

(a) at least one label cover having an elongated main portion and a pair of opposite end portions; and (b) a switch faceplate including a flat main panel and at least a pair of mounting slots defined through said main panel, said mounting slots being spaced apart from one another and adapted to receive therethrough said opposite end portions of said label cover, said label cover being slidable relative to said main panel to insert and remove said opposite end portions of said label cover into and from said mounting slots;

(c) said flat main panel including at least one mounting recess defined in a front surface thereof and extending between said pair of mounting slots, said mounting recess being adapted to receive and seat said main portion of said label cover within said mounting recess with said opposite end portions of said label cover extending through said mounting slots;

(d) said flat main panel also including at least one mounting hole defined through said main panel and being adapted to receive therethrough a fastener to mount said faceplate to a switch box, a portion of said mounting recess overlying said mounting hole;

(e) said faceplate also including a pair of opposite edge surface portions extending generally parallel to one another and spaced from one another on opposite sides of each of said slots, said parallel opposite edge surface portions extending in an inclined relation to the plane of said flat main panel of said faceplate so as to extend along and parallel to a path through which a respective one of said opposite end portions of said label cover must slidably move in order to insert into and withdraw from a respective one of said mounting slots.

2. The assembly as recited in claim 1, wherein said mounting hole is defined through said flat main panel in said mounting recess approximately midway between a pair of opposite ends of said mounting recess.

3. The assembly as recited in claim 1, wherein said opposite edge surface portions defined at said opposite sides of each of said slots also intersect with opposite ends of said at least one mounting recess.

4. The assembly as recited in claim 1, wherein said label cover is made of a semi-flexible semi-rigid material permitting limited flexing of said main portion thereof so as to facilitate insertion and withdrawl of said opposite end portions of said label cover into and from said mounting slots.

5. The assembly as recited in claim 1, wherein said opposite end portions of said label cover are step-shaped end portions being offset below said main portion.

6. The assembly as recited in claim 1, wherein said label cover also has an abutment formed on said main portion adjacent to at least one of said opposite end portions of said at least one label cover.

7. A switch cover plate assembly, comprising:

(a) a plurality of label covers each having an elongated main portion and a pair of step-shaped opposite end portions being offset from said main portion; and (a) a switch faceplate having a flat main panel, a plurality of switch holes defined through said flat main panel and adapted to receive therethrough a plurality of switch actuators, a plurality of mounting holes defined through said flat main panel and adapted to receive therethrough a plurality of fasteners to mount said faceplate to a switch box, and a plurality of label cover mounting recesses defined in said flat main panel and a pair of slots defined through said flat main panel at opposite ends of each of said mounting recesses, each of said recesses and pair of slots being adapted to receive and mount one of said plurality of label covers, each of said label covers being adapted to seat within one of said label cover mounting recesses and to be slidably insertable into and withdrawable from said pair of slots, each of said mounting holes being defined through said flat main panel in one of said mounting recesses and spaced from said pair of slots thereof defined at said opposite ends of said mounting recess.

8. The assembly as recited in claim 7, wherein each of said label covers has a pair of fingernail size grooves on the opposite ends of a front surface of said flat main portion of each of said label covers to use in gripping and sliding said label cover.

9. The assembly as recited in claim 7, wherein said faceplate also has a pair of opposite edge surface portions extending generally parallel to one another and spaced from one another on opposite sides of each of said slots, said parallel opposite edge surface portions extending in an inclined relation to the plane of said flat main panel of said faceplate so as to extend along and parallel to a path through which a respective one of said opposite end portions of each of said label cover must slidably move in order to insert into and withdraw from a respective one of said pair of slots.

10. The assembly as recited in claim 7, wherein each of said label covers also has an abutment formed on a front surface of said main portion adjacent to at least one of said opposite end portions of a respective one of said plurality of label covers.

11. The assembly as recited in claim 10, wherein each of said abutments is defined by a wall portion of a groove defined across at least one of said opposite ends of said main portion to permit insertion and engagement of an object with said label cover to slidably move said label cover relative to said faceplate along said label cover mounting recess and into and from said pair slots.

12. A switch faceplate for a switch cover plate assembly, said faceplate comprising:

(a) a flat main panel;

(b) means defining at least one mounting hole in said flat main panel adapted to receive therethrough a fastener to mount said faceplate to a switch box; and (c) means defining at least one label cover mounting recess in said flat main panel adapted to receive and seat a label cover, at least a portion of said label cover mounting recess overlying said mounting hole in said flat main panel.

13. The faceplate as recited in claim 12, further comprising:

means defining at least one switch hole in said faceplate spaced from said label cover mounting recess and said mounting hole and being adapted to receive a switch actuator therethrough.

14. The faceplate as recited in claim 12, wherein said flat main panel also has at least a pair of mounting slots defined therethrough at opposite ends of said one mounting recess, said mounting slots being adapted to receive opposite ends of the label cover seated in said main portion of said label cover.

15. The faceplate as recited in claim 14, wherein said mounting hole is defined through said flat main panel in said mounting recess approximately midway between a pair of opposite ends of said mounting recess.

16. A switch faceplate for a switch cover plate assembly, said faceplate comprising:

(a) a flat main panel;

(b) means defining at least a pair of mounting slots through said flat main panel being located in spaced relation to one another, said mounting slots being adapted to receive and mount opposite end portions of a label cover; and (c) means defining at least one mounting hole in said flat main panel between and spaced from said pair of mounting slots and being adapted to receive therethrough a fastener to mount said faceplate to a switch box;

(d) said flat main panel including at least one mounting recess defined in a front surface thereof and extending between said pair of mounting slots, said mounting recess being adapted to receive and seat a main portion of the label cover within said mounting recess with said opposite end portions of the label cover extending through said mounting slots, said mounting recess being disposed in overlying relation to said mounting hole.

* * * * *